US006239414B1

(12) United States Patent
Newcomer

(10) Patent No.: US 6,239,414 B1
(45) Date of Patent: May 29, 2001

(54) STOVE AUTOMATIC SHUT OFF CONTROL

(76) Inventor: Charles W. Newcomer, #3 John Lucy La. P.O. Box 3832, Lufkin, TX (US) 75903

( * ) Notice: Subject to any disclaimer, the term of this patent is extended or adjusted under 35 U.S.C. 154(b) by 0 days.

(21) Appl. No.: 09/585,782

(22) Filed: Jun. 5, 2000

(51) Int. Cl.[7] ..... H05B 3/68; H05B 1/02
(52) U.S. Cl. ..... 219/447.1; 219/518
(58) Field of Search ..... 219/446.1, 447.1, 219/518; 99/280, 281

(56) References Cited

U.S. PATENT DOCUMENTS

| | | | | |
|---|---|---|---|---|
| 2,020,364 | | 11/1935 | Lehmann . | |
| 2,070,491 | | 2/1937 | Park . | |
| 2,520,788 | * | 8/1950 | Wales | 219/518 |
| 2,715,176 | * | 8/1955 | Schoberle | 219/518 |
| 3,586,824 | * | 6/1971 | Barney | 219/518 |
| 4,164,644 | | 8/1979 | Remsnyder et al. . | |
| 4,334,955 | | 6/1982 | Zoeke et al. . | |
| 5,823,095 | * | 10/1998 | Walker | 219/518 |

FOREIGN PATENT DOCUMENTS 2467-577 10/1979 (FR) .

* cited by examiner

*Primary Examiner*—Sang Paik
(74) *Attorney, Agent, or Firm*—Gordon K. Anderson

(57) ABSTRACT

A stove automatic shut off control for boiling a liquid which has a hinged platform (20) for holding a liquid container (22) held horizontally by a compression spring (24) which is axially urged downward when the container includes a liquid. Spring tension is changed by manual rotation of a shaft (38) modifying the spring compressive force displaced on the hinged platform by the spring. A contact switch (50) is energized when the weight of the liquid in the container changes from a pre-set level raising the spring. A reset timer (52) and an enunciator (54) communicate with the contact switch and force the control shaft to be pulled inward in a linear direction and also audibly indicate that the stove automatic shut off control is to shut down. To pre-set the apparatus the shaft is rotated with a hand knob (46) to raise the platform and then the shaft is pulled out. The on/off switch (62) is turned "on" and the container, including liquid, is placed on the platform with the knob adjusted until the contact switch energizes pulling the shaft inward. The user adds a small amount of liquid to the container and again pulls the shaft out. The stove automatically shuts off when boiling of the liquid has reduced its weight to the original set point level.

14 Claims, 2 Drawing Sheets

22
26
20
24'
50
24
32
28
24"
2
30
56
2
36
34
44
38
48
3
3
52
46
38
44

30
50
24
32
32
28
40
42
38
58
38
52

44
48
46
52

STOVE AUTOMATIC SHUT OFF CONTROL

TECHNICAL FIELD

The present invention relates to controls for stoves in general. More specifically to an automatic control mechanism that turns off the stove when liquid has boiled to the desired level.

BACKGROUND ART

Previously, many types of devices have been developed in endeavoring to provide an effective means for controlling the amount of evaporation of a liquid on a stove or other heating apparatus. In most cases the liquid is housed in a given volume container and a spring is used that is non adjustable or the adjustment must be made by experimentation. Others use pressure switches which are responsive to a predetermined weight of the container or boils the liquid into another container reducing the weight and opening an electric circuit to turn off the heat source.

A search of the prior art did not disclose any patents that read directly on the claims of the instant invention, however the following U.S. patents are considered related:

| Patent Number | Inventor | Issue Date |
|---|---|---|
| 4,334,955 | Zoeke et al. | Jun. 15, 1982 |
| 4,164,644 | Remsnyder et al. | Aug. 13, 1979 |
| 2,070,491 | Park | Feb. 9, 1937 |
| 2,020,364 | Lehmann | Nov. 12, 1935 |
| Foreign Patents | | |
| FR2467-577 (France) | Santini | Oct. 23, 1979 |

Zoeke et al. in U.S. pat. No. 4,334,955 teaches a device for controlling evaporation of liquid using a container on a base plate supported by a leaf spring. The spring loaded plate allows the plate to move between two micro switches depending upon the amount of liquid in the container. The switches are connected to a control circuit for activating the heating element and interrupt the flow of power to the heating element when little or no liquid is present in the container.

U.S. Pat. No. 4,164,644 issued to Remsnyder et al is for a heating unit which heats the contents of a container. An electrical circuit is responsive to a pressure switch that reacts to a predetermined weight of material in the container. A pivotally mounted heating element activates a switch which interrupts the circuit in the event of overheating. The heating unit is provided with a heating element having a conical center portion surrounded by an annular flat or planar surface for receiving a container having only a predetermined shaped bottom for accommodating the particular shape heating element.

Park in U.S. pat. No. 2,070,491 discloses a heating system that passes a circuit of high amperage and low voltage power directly thorough a pan. The pan has downwardly projecting prong like contacts which firmly engage the pan to an electric power supply. The high amperage and low voltage may utilize the secondary circuit of a transformer from 110 volt lighting mains. When the heating is completed, a switch energizes a solenoid and power flows thorough to a motor magnet providing the released of the clamps.

Lehmann in U.S. pat. No. 2,020,364 teaches means for adjusting a device for receptacles or containers differing in weight to provide a varying minimum in weight of content to render the heating device ineffective. A tension spring reacts on a lever to separate electrical contacts when the weight of the container and its contents reach a predetermined minimum. The combined minimum weight can be experimentally determined by the adjustment of the spring element when the liquid in the container is just, or slightly more that sufficient to protect the container from overheating. No attention is required to protect the device from overheating since it will automatically shut off when the minimum amount of liquid in the container is reached.

Santini in French patent FR2467-577 discloses a milk bottling appliance using two vessels one taller than the other with a spout on the taller of the two overhanging the smaller vessel. The taller vessel is placed on a heating plate which has a vertical rod passing therethrough which acts as a counterweight holding the plate horizontal against a stop on the rod. When the vessel is filled the weight of the fluid overcomes the counter weight and the lever falls closing a spring contact which closes an electric circuit to the heating element. Once the liquid has boiled over into the smaller vessel the reduced weigh to the heating vessel allows the lever to rise and the spring contacts to opens the electric circuit.

DISCLOSURE OF THE INVENTION

In the past stoves for cooking rely on the user to manually control the cooking time on stove top heating. Help is sometimes used such as built in timers that indicate the lapsed time using a buzzer to warn the user that the preset time has lapsed and the cooking period is finished. While this type of warning is usually sufficient for warming foods or when the cooking time is actually known, if the heat is continued beyond this point disastrous results may occur. This problem is obvious when boiling a liquid for a time period when it is not a certainty as to the actual time it takes to accomplish the end result. In this case a timer is of little use and it is therefore expedient that the user pays strict attention to the process. It is therefore a primary object of the invention to have a system that is easy to operate and simple to control using automatic features that rely on the weight of the liquid to be boiled by presetting the system originally and then adding a small additional amount to the container, to allow for evaporation, with the stove then automatically shutting down when the original level is achieved.

An important object of the invention is the protection that is afforded by preventing the food to be ruined by overcooking or even by burning the food when the moisture content has been lowered to a point where the heat actually begins to alter the structure of the food itself.

Another object of the invention is the freedom that is afforded to the user as once the stove has been adjusted and the automatic control pre-set no further attention is required as the stove will shut itself off at the exact time.

Still another object of the invention is to eliminate the possibility of odor of burned food on the stove top that may permeate the entire kitchen and sometimes even the entire house that could have lasting effects.

Yet another object of the invention is the prevention of liquid in the container actually burning to the extent that other materials near the stove may catch on fire which may lead to catastrophic results.

A further object of the invention averts the possibility of the container to boil dry actually melting the metal and destroying the surrounding area, this anomaly is particularly apparent with aluminum containers.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figures 1, 2, 3, 4:
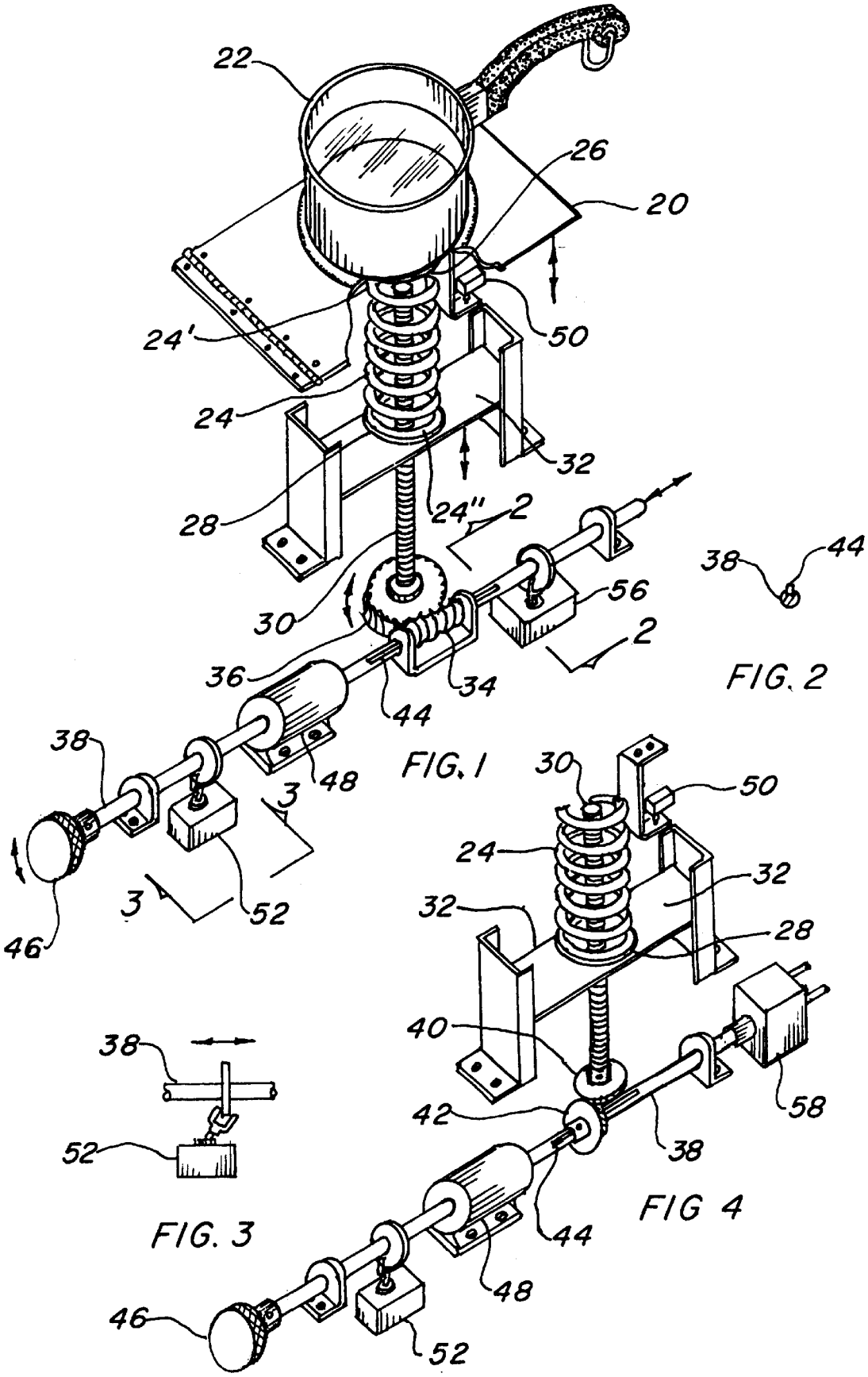
FIG. 1 is a partial isometric view of the preferred embodiment for an electric range.
FIG. 2 is a cross sectional view taken along lines 2—2 of FIG. 1 illustrating the spline in the shaft.
FIG. 3 is a cross sectional view taken along lines 3—3 of FIG. 1 illustrating the toggle yoke on the delay reset timer.
FIG. 4 is a fragmentary partial isometric view of the preferred embodiment, as illustrated in FIG. 1, except it is for a gas range and utilizes beveled gears instead of worm gears.
Figure 5:
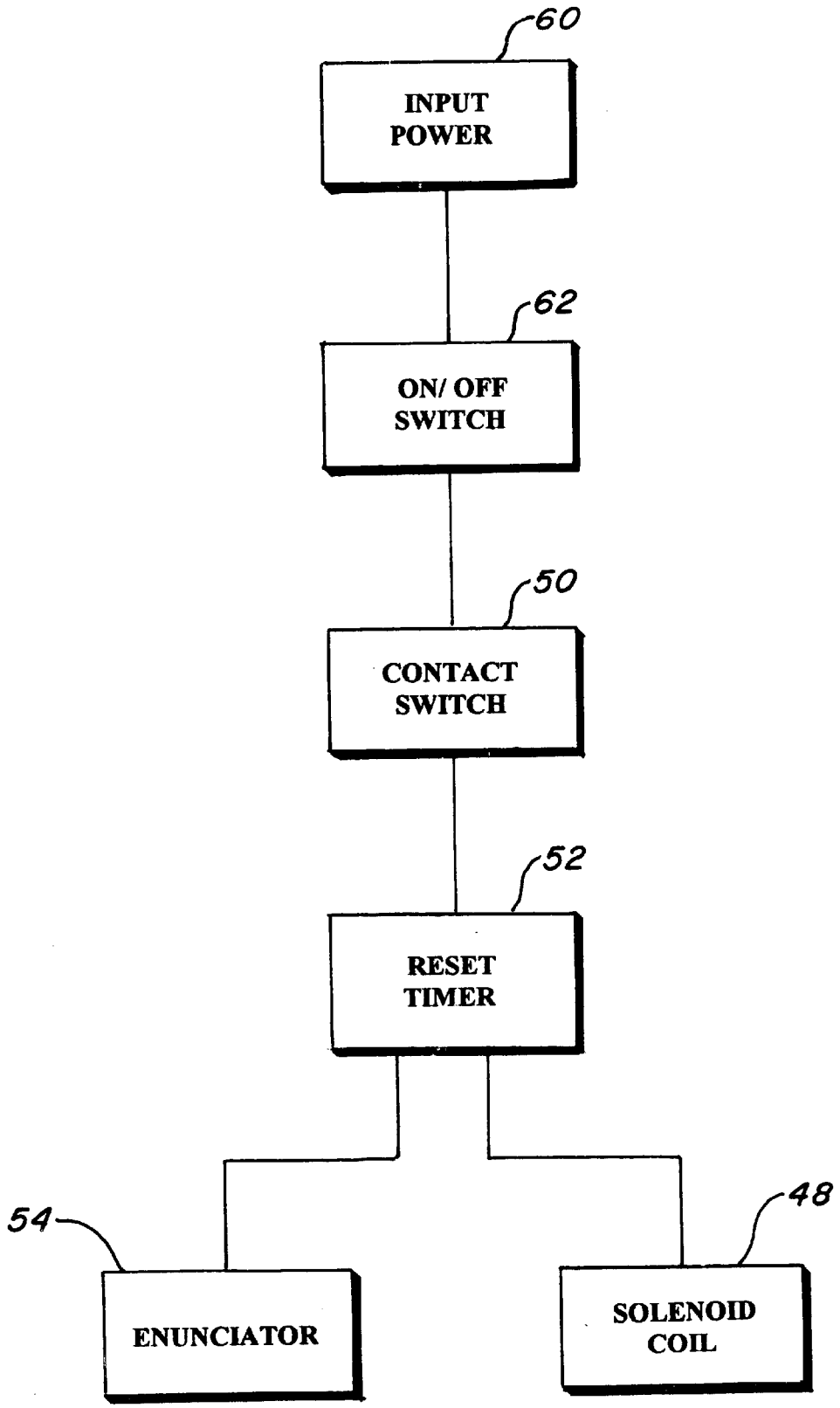
FIG. 5 is a block diagram of the electrical system for the invention.

The best mode for carrying out the invention is presented in terms of a preferred embodiment. This preferred embodiment is shown in FIGS. 1–5 and is comprised of a hinged platform 20 holding a liquid container 22 thereon as shown in FIG. 1. The platform 20 may be any type such as a grate or a grille on gas ranges or an electrical resistance element on an electric range. It should be noted that the illustration depicts only a theoretical image not an actual component.

Compression spring means are located under the hinged platform 20 such that weight of the liquid container 22 is supported on the spring means and the platform 20 is axially urged downward when the container 22 includes a liquid inside. The compression spring means are in the form of a compression spring 24 having a first end 24' and a second end 24", with a spring retaining ring 26 integral with the hinged platform 20 contiguous with the spring first end 24'. A spring keeper 28 engages the spring second end 24". The spring retaining ring 26 and spring keeper 28 may interface with either the inside of the spring 24 or the outside and may be either a continuous ring or an upstanding projection, and the like.

Spring tension changing means are in communication with the spring 24 for altering the spring's compressive force that is displaced on the bottom of the hinged platform 20, as shown in the drawings. Spring tension changing means are in the form of a rod 30 that is threaded at least part of its length and a height adjusting structure 32 that has the spring keeper 28 threadably engaging the rod 30. Adjustment is made by rotating the rod 30 which in turn moves the height adjusting structure 32 linearly in either an upward or a downward direction according to the rods rotation. This movement is illustrated with a double headed arrow in FIG. 1.

Gear means interface with the spring means for changing horizontal rotation to a vertical rotation as applied to the rod 30. This gear means consist preferably of a worm 34 and a mating worm gear 36 with the worm 34 attached to a control shaft 38 and the worm gear 36 attached to the threaded rod 30 as depicted in FIG. 1. An alternate to this arrangement is illustrated in FIG. 2 where a pair of bevel gears are used which consists of a first beveled gear 40 and a second beveled gear 42 with the first beveled gear 40 attached to the control shaft 38 and the second beveled gear 42 attached to the threaded rod 30. It will be noted that either approach will function equally well and even other techniques may be employed with equal ease as long as they change horizontal rotation to vertical rotation employing mechanical means. It will also be noted that the worm 34 or second beveled gear 42 stay stationary relative to there appropriate mating gear however the control shaft 38 is free to move in a linear direction which is permitted by the use of a spline in the form of a key 44 positioned in a mating keyway in both the shaft 38 and either in the worm 34 or gear 42. The clearance between the above elements is sufficient to permit this linear movement and yet the key 44 permits rotational torque transmission to the worm or gear for changing the ultimate direction.

Since the control shaft 38 is rotatably connected to the gear means when the shaft 38 is rotated the spring tension changing means are also rotated modifying the compressive force of the spring 24 on the hinged platform 20. A hand knob 46 is positioned on an extended end of the shaft 38 to permit an operator to manually rotate the shaft 38 to lower or raise the hinged platform 20. It is also possible to pull the shaft 38 to an outward position or to push it into a inward position by grasping the knob 46 by hand.

Means for urging the control shaft 38 in a linear direction for completion of the stove automatic shut off are provided by the use of the hand knob 46 for manual manipulation, as explained above, and a solenoid coil 48 for electromagnetic linear actuation. The solenoid coil 48 encompasses the control shaft 38 extending completely through the center portion of the windings creating a complete solenoid as such. When the solenoid coil 48 is electrically actuated the windings surrounding the shaft 38 create an electromagnetic field forcing the shaft in a linear direction until polarization is achieved.

Switch means contiguously engage the hinged platform 20 when adjusted by the spring tension changing means. The switch means consist of a contact switch 50 having a linear actuator in the form of a plunger or a lever either with or without a roller such that the actuator comes in contact directly with the platform 20 or a bracket attached thereunto as illustrated.

A delay reset timer 52 and an enunciator 54 are in electrical communication with the switch means and the means for urging the control shaft in a linear direction. The enunciator 54 audibly indicating that the stove automatic shut off control is shut down and the timer 52 limits the duration of this signal. The timer 52 is preferably the solid state type that has a predetermined time function in seconds with essentially a one or two second function and a manual reset toggle. The enunciator 54 may be a buzzer, beeper, klaxon or the like as long as the signal is audible.

Heat source cut off means are contiguously engaged by the means for urging the control shaft in a linear direction using either the knob 46 or the solenoid coil 48 and function to terminate operation of the stove when the boiling liquid has reduced its own weight on the platform 20 to the predetermined level. The heat source cut off means consist of a stove electrical heating element control switch 56 for an electric range or a stove fuel shut off valve 58 for a gas range. The stove electrical heating element control switch 56 is illustrated in FIG. 1 and the stove fuel shut off valve 58 is shown in FIG. 4. It will be noted that these elements are part of the stove or are secondary devices that function in conjunction with the original equipment manufacturers elements and their sole purpose is to shut off power or fuel to the stove. As a gas range requires physical movement a solenoid or the like may be used or the original fuel shut off valve, if it has a manual lever, may be linked to the shaft 38 as illustrated. Since each stove may require a different approach, the drawings are only representative of the desired function.

Electric control means are required for energizing the automatic shut off control and for audible indication of the inventions functional operation. The control means consist of an input power supply 60 from city power mains which, in domestic housing, is normally 110/120 volt single phase 60 hertz which is used by the range for lighting and other purposes.

In order to energize and isolate the invention from the balance of the stoves controls an on/off switch 62 is used which is in electrical communication with the input power supply 60 for placing the automatic shut off control in operation and to de-energize the system entirely. It should be noted that the balance of the stoves controls are not effected by the addition of the invention and its operation is controlled entirely by the on/off switch 62 since rotating the knob 46 only mechanically moves the platform 20 but does not turn on or off anything until the switch 62 is energized.

The contact switch 50 is in electrical communication with the on/off switch 62 and is also in mechanical union with the hinged platform 20 such that when the platform 20 is depressed by weight of a container 22, having liquid therein, the switch 50 opens contacts and when the platform is raised by reduced weight of the container having displaced some of the liquid by boiling the switch closes and makes a circuit, as previously discussed.

The reset timer 52 is in electrical communication with the contact switch 50 and also mechanically engages the control shaft 38 such that when the contact switch 50 closes making a circuit the timer 52 is energized for a predetermined time period and is mechanically reset when the control shaft is manually pulled out. FIG. 3 illustrates the mechanical linkage necessary to reset this timer 52.

The enunciator 54 is in electrical communication with the reset timer 52 and is actuated for a predetermined time period creating an audible signal that the inventions function has been accomplished.

The solenoid coil 48 that surrounds the shaft 38 is in electrical communication with the reset timer 52 drawing the shaft 38 inward when the timer 52 is actuated for the predetermined length of time.

In operation, the on/off switch 62 is turned to the on position and the knob 46 is rotated to increase spring pressure on the platform 20 raising it upward away from the stove. The knob 46 is then pulled out which permits the apparatus to function. A container 22 is filled to the desired level with liquid and placed on the platform 20 and the knob 46 is rotated to reduce the tension on the spring 24 until the contact switch 50 is energized. At this point the solenoid coil 48 draws the shaft 38 inward to the off position and the enunciator 54 sounds for a few seconds until both it and the solenoid are turned off by the reset timer 52. At this time in the procedure either the heating element control switch 56, or in the event of a gas range, the fuel shut off valve 58 is turned off preventing operation of the stove by the conventional controls. The next step is to add a small amount of liquid to the container 22 increasing the weight on the platform 20 disengaging the contact switch 50. The knob 46 is pulled out a second time releasing the stove shut off switch 56 or valve 58 and resetting the timer 52. The stove may then be turned on using the conventional controls. It should be noted that if insufficient liquid is added after the knob 46 is pulled out the second time the knob will automatically be pulled in again and this step must be repeated again until the proper liquid level is satisfied. When stove is operating and the liquid in the container 22 has evaporated to the desired level the control switch 50 contacts the platform 20 and energizes the solenoid coil 48 and enunciator 54, until stopped by the reset timer as described above, this function automatically pulls the knob 46 and shaft 38 inward by the electromagnetic force and mechanically energizes the timer 52 for a few seconds and turns off the stove shut off switch 56 or valve 58.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A stove automatic shut off control for boiling a liquid comprising:

a hinged platform holding a liquid container thereon, compression spring means disposed under the hinged platform such that weight of the liquid container is supported on the spring means and the platform is axially urged downward when the container includes a liquid, spring tension changing means in communication with the spring means for altering the spring compressive force displaced on the hinged platform by the spring means, gear means interfacing with the spring means for changing horizontal rotation to vertical rotation, a control shaft rotatably connected to the gear means such that when the shaft is rotated the spring tension changing means are rotated modifying the spring compressive force displaced on the hinged platform by the spring means, means for urging said control shaft in a linear direction for completion of said stove automatic shut off, switch means contiguously engaging said hinged platform when adjusted by said spring tension changing means, a delay reset timer and an enunciator in electrical communication with said switch means and said means for urging said control shaft in a linear direction audibly indicating that the stove automatic shut off control is to shut down, heat source cut off means contiguously engaged by said means for urging said control shaft in a linear direction for functional termination of the stove when boiling of liquid has reduced its weight on the platform, and electric control means for energizing the automatic shut off control and audible indication of the invention.

2. The stove automatic shut off control for boiling a liquid as recited in claim 1 wherein said hinged platform for holding a liquid container is a grate.

3. The stove automatic shut off control for boiling a liquid as recited in claim 1 wherein said compression spring means further comprising, a compression spring having a first end and a second end, a spring retaining ring integral with said hinged platform contiguous with the spring first end and a spring keeper contiguous with the spring second end.

4. The stove automatic shut off control for boiling a liquid as recited in claim 1 wherein said spring tension changing means further comprising a rod having threads thereon and a height adjusting structure, having a spring keeper thereon, threadably attached to the rod such that when the rod is rotated the height adjusting structure is linearly displaced in either an upward or a downward direction.

5. The stove automatic shut off control for boiling a liquid as recited in claim 1 wherein said gear means for changing horizontal rotation to vertical rotation further comprising a worm and a mating worm gear with the worm attached to a control shaft and the worm gear attached to the spring tension changing means.

6. The stove automatic shut off control for boiling a liquid as recited in claim 1 wherein said gear means for changing horizontal rotation to vertical rotation further comprising a pair of bevel gears, defining a first beveled gear and a second beveled gear with the first beveled gear attached to the control shaft and the second beveled gear attached to the spring tension changing means.

7. The stove automatic shut off control for boiling a liquid as recited in claim 1 wherein said control shaft further having a hand knob on an extended end such that an operator may rotate the knob to lower or raise the hinged platform.

8. The stove automatic shut off control for boiling a liquid as recited in claim 1 wherein said means for urging said control shaft in a linear direction further comprising a hand knob for manual manipulation and a solenoid for electromagnetic linear actuation.

9. The stove automatic shut off control for boiling a liquid as recited in claim 1 wherein said switch means further comprising a contact switch having a linear actuator.

10. The stove automatic shut off control for boiling a liquid as recited in claim 1 wherein said delay timer and enunciator further comprising a solid state timer and a buzzer.

11. The stove automatic shut off control for boiling a liquid as recited in claim 1 wherein said heat source cut off means further comprising a stove electrical heating element control switch.

12. The stove automatic shut off control for boiling a liquid as recited in claim 1 wherein said heat source cut off means further comprising a stove fuel shut off valve.

13. The stove automatic shut off control for boiling a liquid as recited in claim 1 wherein said electric control means further comprising;

a input power supply from city power mains, an on/off switch in electrical communication with the input power supply for placing the automatic shut off control in operation and to de-energize the system entirely, a contact switch in electrical communication with the on/off switch and in mechanical union with the hinged platform such that when the platform is depressed by weight of a container having liquid therein the switch opens contacts and when the platform is raised by reduced weight of the container, having displaced some liquid by boiling, the switch closes and makes a circuit, a reset timer in electrical communication with the contact switch and also mechanically engaging the control shaft such that when the contact switch closes making a circuit the timer is energized for a predetermined time period and mechanically reset when the control shaft is manually pulled out, an enunciator in electrical communication with the reset timer and actuated for a predetermined time period creating an audible signal that a function has been accomplished, and a solenoid coil surrounding the control shaft in electrical communication with the reset timer drawing the control shaft inward when the timer is actuated for a predetermined time period.

14. A stove automatic shut off control for boiling a liquid comprising:

a spring loaded hinged platform holding a liquid container thereon such that the container weight is supported on the platform and is axially urged downward when the container includes a liquid, spring adjusting means contiguous with said platform for altering a spring compressive force placed under the hinged platform for spring loading, switch means contiguously engaging said hinged platform when adjusted by said spring adjusting means, a control shaft rotatably connected to the spring adjusting means such that when the shaft is rotated the spring compressive force is altered angularly displacing the hinged platform, means for urging said control shaft in a linear direction for completion of said stove automatic shut off, and heat source cut off means contiguously engaging said control shaft such that when said shaft is moved inward functional termination of the stove will occur when boiling of liquid has reduced its weight on the platform.

* * * * *